US008156975B1

(12) United States Patent
Pickering

(10) Patent No.: US 8,156,975 B1
(45) Date of Patent: Apr. 17, 2012

(54) PROTECTIVE COVER

(76) Inventor: Stephen Bryan Pickering, Marshall, MI (US)

( * ) Notice: Subject to any disclaimer, the term of this patent is extended or adjusted under 35 U.S.C. 154(b) by 0 days.

(21) Appl. No.: 12/534,195

(22) Filed: Aug. 3, 2009

Related U.S. Application Data

(60) Provisional application No. 61/137,879, filed on Aug. 4, 2008.

(51) Int. Cl.
*B65D 65/02* (2006.01)
*E04H 15/54* (2006.01)

(52) U.S. Cl. ..... 150/158; 150/154; 150/165; 135/115; 135/96

(58) Field of Classification Search ..... 135/115, 135/117, 119, 96, 901; 150/154, 158, 165; 297/228.12; 108/90, 161, 50.12
See application file for complete search history.

(56) References Cited

U.S. PATENT DOCUMENTS

| | | | | |
|---|---|---|---|---|
| 4,576,904 | A * | 3/1986 | Anitole | 430/347 |
| 5,293,709 | A * | 3/1994 | Cripe | 43/3 |
| 5,477,875 | A | 12/1995 | Daly, Jr. | |
| 5,528,849 | A | 6/1996 | Plinta | |
| 5,582,115 | A * | 12/1996 | Muller | 108/90 |
| 5,924,131 | A * | 7/1999 | Wilkinson | 2/69 |
| 5,972,479 | A * | 10/1999 | Lehman | 428/195.1 |
| 6,014,935 | A * | 1/2000 | Willett | 108/90 |
| 6,342,290 | B1 | 1/2002 | Conk | |
| 6,357,461 | B1 * | 3/2002 | Chai et al. | 135/88.09 |
| 6,456,255 | B1 | 9/2002 | Lundahl | |
| 6,709,055 | B2 | 3/2004 | Gengler et al. | |
| 6,748,877 | B2 * | 6/2004 | Kelldorf | 108/90 |
| 6,859,983 | B2 * | 3/2005 | Curtis et al. | 28/104 |
| 6,941,961 | B1 * | 9/2005 | Eastman, II | 135/121 |
| 7,152,733 | B2 * | 12/2006 | Trickett | 206/320 |
| 7,735,503 | B2 * | 6/2010 | Jenkinson | 135/96 |
| 2002/0069904 | A1 * | 6/2002 | Robinson | 135/87 |
| 2004/0016485 | A1 * | 1/2004 | Muller | 150/158 |
| 2009/0100736 | A1 * | 4/2009 | Bunce et al. | 43/1 |
| 2009/0211673 | A1 * | 8/2009 | Neren | 150/165 |

* cited by examiner

*Primary Examiner* — Winnie Yip
(74) *Attorney, Agent, or Firm* — Young Basile Hanlon & MacFarlane P.C.

(57) ABSTRACT

The invention is a protective cover for an object stored outdoors. The cover is weather-proof, and a photographic image of plants, vegetation, ground cover or foliage is applied to the outer surface of the cover, whereby the appearance of the outer surface of the cover is designed to emulate the exterior appearance of outdoor plants, vegetation, ground cover and foliage, thereby serving to camouflage objects which are being protected by the cover. A low reflectivity texture is imparted to the outer surface of the cover.

15 Claims, 2 Drawing Sheets

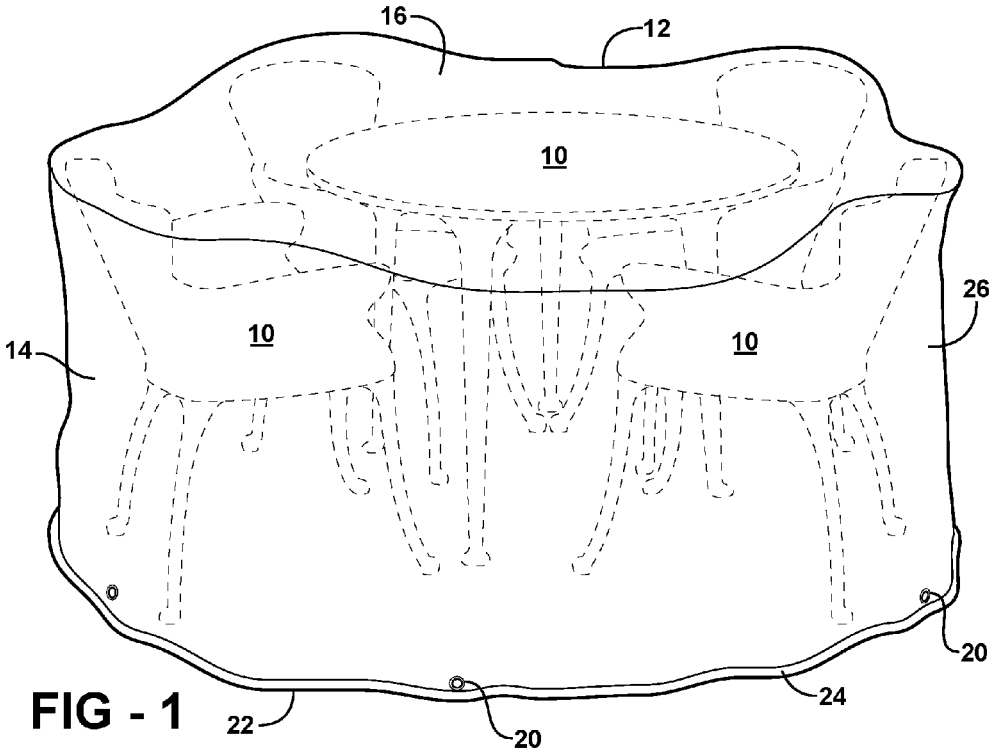
FIG - 1
FIG - 3
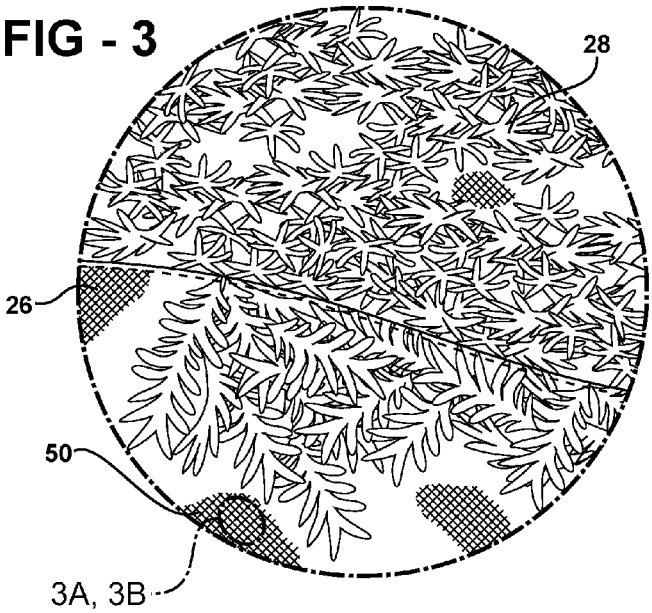
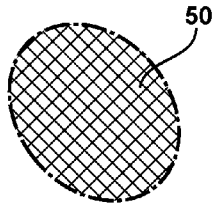
FIG - 3A
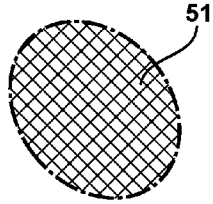
FIG - 3B

PROTECTIVE COVER

CROSS-REFERENCE TO RELATED APPLICATIONS

This application claims the benefit of U.S. Provisional Patent Application Ser. No. 61/137,879, filed on Aug. 4, 2008.

FIELD OF THE INVENTION

The invention pertains to protective covers for items stored outdoors and specifically, for such covers having a decorative exterior surface, which emulate the appearance of plants, vegetation, ground cover or foliage in the outdoor environment.

BACKGROUND OF THE INVENTION

Modern residential living often includes utilization of the outdoor area surrounding homes and other residential structures. Expansive lawns, patios and decks remain highly desirable features of a modern home. Associated with these outdoor living spaces are a wide variety of outdoor furnishings, including, for example, chairs, tables and cooking stations, such as barbecue grills, which are specifically designed and engineered for outdoor use and storage.

While these furnishings are capable of being stored outside throughout the year, in many climates, utilization of the outdoor space is undesirable in the winter months, and even when the climate is conducive to outdoor activities and utilization of these types of furnishings, it is often desirable to protect such outdoor furnishings from the elements when the furnishings are not in use.

It is well known to provide protective covers for such furnishings. Such covers may be made of fabric, such as canvas, or more modern fabric, such as polyurethane. By treating these fabrics, they may be made impervious to moisture and ultraviolet radiation, thereby providing substantial protection to the items therein enclosed. Typically, such coverings are made of a size and shape to approximately conform to the exterior dimensions of the object being protected, and such coverings are also typically lightweight and flexible, allowing them to be easily removed, stored, and later reinstalled as needed without undue effort.

A major drawback to such coverings, however, is their appearance. Typically, such coverings are monochromatic. Neutral colors, such as white or tan, are frequently selected, because of the tendency of fabric dyes to fade over time, a tendency which is less pronounced in fabrics with little or no dye.

Another drawback to many of the materials utilized is their tendency to attract and hold airborne contaminants, such as dirt, which tend, over time, to become deposited on and absorbed into the fibers of the fabric. To minimize this difficulty, some outdoor protective covers are provided with a smooth coating to seal the fabric. However, such coatings tend to be highly reflective, and the shiny appearance of the covers so manufactured is often esthetically displeasing.

Because of their monochromatic appearance and their shape when installed over the furnishings to be protected, existing covers present a somewhat stark and desolate appearance to the outdoor environment, and call attention to the presence of a scattered collection of objects which is readily contrasted against the natural outdoor environment. Although fabrics and covers with drawings or other facsimiles of simulated foliage are known, existing patterns are designed for hunter camouflage, and are designed to deceive the animal, as opposed to the human eye. Typical of the art is U.S. Pat. No. 6,709,993, which depicts a simplified camouflage pattern first surface of material, and U.S. Pat. No. 4,865,900, which likewise provides an article having a surface pattern adapted to blend into a leafy environment. It is also known to create camouflage patterns from photographic images, as shown in U.S. Pat. No. 6,342,290, which teaches the selection and organization of pattern elements on camouflage material in the pattern and ecotone motif of a selected outdoor environment. However, none of the prior art devices are designed to simulate the appearance of a plant, such as an outdoor tree or shrub. Further, none of the prior art devices addresses the problems of reflectivity herein described.

It is desirable, therefore, to create an outdoor furnishing covering which more readily blends into the surrounding environment, and presents a more pleasing appearance to the eyes, while at the same time providing the advantages of the prior art, specifically, protection from the elements, portability, lightweight, and resistance to the accumulation of contaminants, as well as resistance to discoloration over time. The present invention accomplishes each of these goals.

DETAILED DESCRIPTION OF THE DRAWINGS

FIG. 1 is a perspective view of the invention depicting furnishings contained therein in ghost view.

FIG. 3 is a detailed view of one embodiment of the invention showing a suitable image imprinted therein.

FIG. 3A is a magnified detail view depicting a surface texture of one embodiment.

FIG. 3B is a magnified detail view depicting a surface texture of one embodiment.

DETAILED DESCRIPTION OF THE EMBODIMENT

Figure 2:
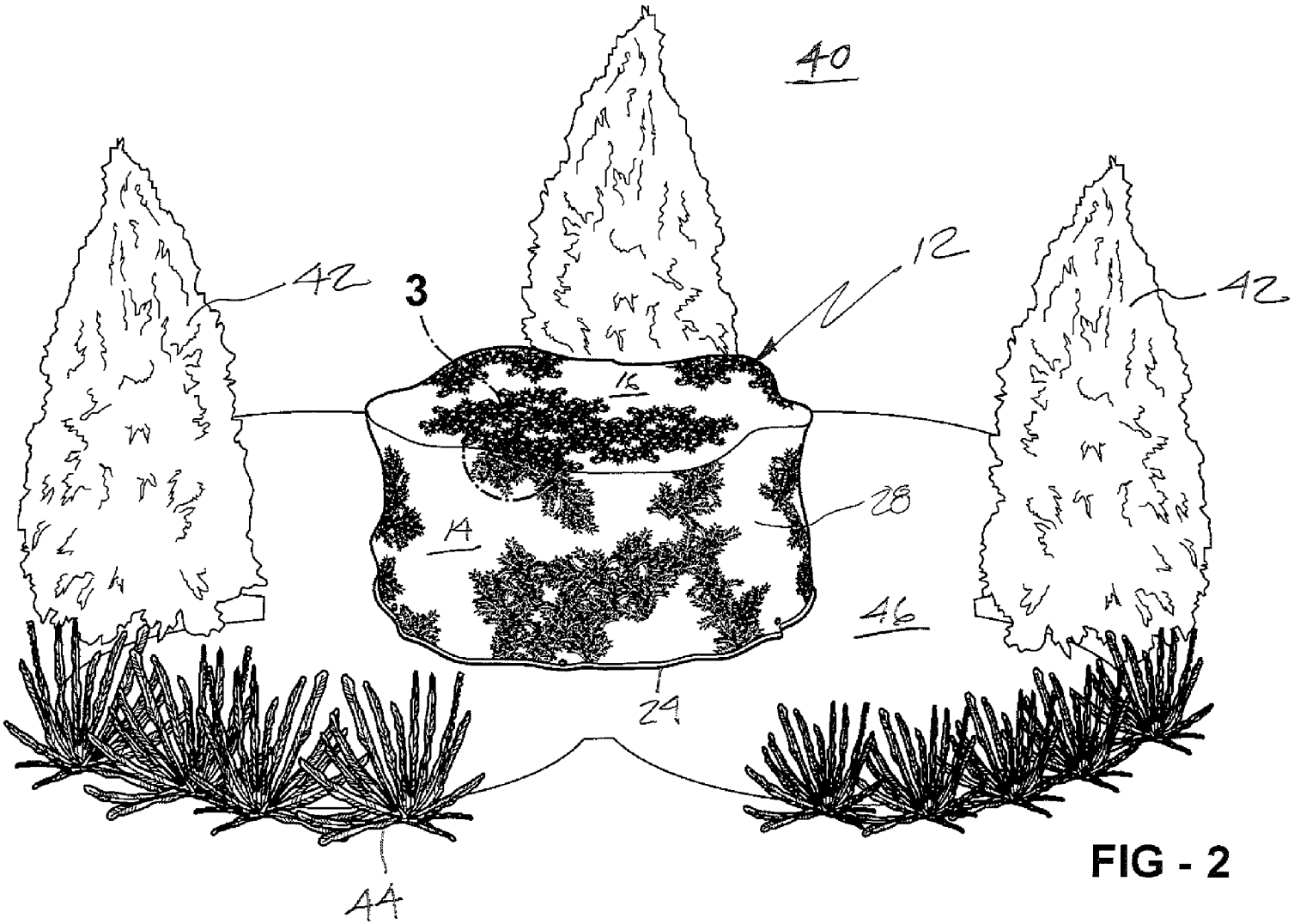
FIG. 2 is a perspective view of the invention in a typical outdoor environment.

The present invention will be best understood by reference to the enclosed drawings, FIG. 1 through FIG. 3A.

In the embodiment, objects 10 to be covered, protected and concealed, such as a chair, table, propane tank or barbecue appliance are typically located in an outdoor environment, such as a patio or lawn. A cover 12 is constructed of a flexible material such as synthetic fabric or plastic film. Typical fabrics include nylon, Dacron or polyurethane-based materials, selected for properties of flexibility, durability and light weight. In a typical embodiment, the cover 12 is fabricated of one or more panels of material in such a fashion as to produce a finished cover which has a shape which corresponds approximately to the shape of the object 10 being protected and concealed. For example, in FIG. 1, table and chairs are provided (shown in phantom view), and cover 12 is formed to approximate the dimensions and shape of the collection of tables and chairs. Each cover 12 has a perimeter section 14, top 16 and an open bottom 22 surrounded by a bottom edge 24. Preferably, the bottom edge 24 is provided with a plurality of eyelets 20 which permit the bottom edge 24 of the cover 12 to be secured to a surface on which the object 10 and cover 12 are placed or to permit a plurality of eyelets 20 to be interconnected by a rope or similar flexible element (not shown) to act as a drawstring and thereby secure the bottom edge 24 of the cover 12 to the object 10. In the embodiment, an image 28 is imprinted on or within the fabric or film of cover 12. The image is preferably a 360° image formed by producing a 360° photograph of the entire circumference of a shrub or bush. Further, an additional image of a shrub or bush is made and applied to the top 16. The 360° image of the periphery of the shrub or bush is then combined with the photograph of the shrub or bush taken from the top. The two images are placed on the cover 12 so that the top image is placed on the top 16 and the peripheral image is placed around the perimeter 14 of the cover 12. The resulting cover 12 then presents the appearance, to the ordinary observer, of a shrub, bush or other plant, while at the same time securing and protecting the object 10 contained within the perimeter 14 and under the top 16 of the cover 12.

It will be appreciated, in addition to the foregoing, however, that covers for individual items, such as a single chair or single table could similarly be fabricated, so that covers designed for surrounding multiple pieces of furniture or covers designed for the enclosure of a single individual object could likewise be manufactured and utilized.

In one embodiment, the exterior of the cover 12 is provided with a coating 26 which is impervious to moisture, but at the same time slightly matted in texture, thereby attenuating the reflectivity of the coating 26, and thereby minimizing the reflection and shine which may be found in prior art coverings having a high gloss surface. By providing a somewhat lower gloss, matted coating 26, the cover 12 and the associated image 28 more accurately emulate the appearance of actual plants or foliage.

It will be appreciated that the images 28 selected for placement on the cover 12 may be selected to match the typical outdoor environment of the geographical area in which the covers will be used. In northern climates, for example, evergreen shrubs may be the most desirable image for placement on the cover, whereas in a southwestern environment, certain types of desert foliage, such as cacti will be preferable. In a seaside environment, by way of further example, the image may include sandy soil, cattails and saw grasses.

In use, an object 10 is located or positioned in a typical residential outdoor lawn environment, and the cover 12 is placed over the object and secured as above-described utilizing eyelets 20. The object 10 is thereby concealed from view, and protected from the elements. When it is desired to utilize the object for its intended purpose, the cover 12 is removed and folded for storage. When in use, the cover presents a pleasing appearance emulating other foliage in the outdoor environment. When properly configured, the cover, seen from a distance, can be virtually indistinguishable from actual foliage in the environment.

As shown in FIG. 2, it will be appreciated that placement of the cover 12 over an object in an outdoor environment 40 which may include vegetation 44, trees 42 and ground cover 46 will allow the cover 12 to blend with and appear part of the overall environment 40.

It will be appreciated from FIGS. 3, 3A, and 3B that the desired degree of reflectivity may be obtained by selection of the weave 50 of a fabric substrate of a base material for the cover 12 which may be of natural or synthetic cloth by including a coating comprising a textured surface 51, or by the inclusion of impressions into the surface of a plastic film forming cover 12 during the process of forming the film. Such impressions may be in any of a wide variety of cross-sections, such as impressions which would emulate a fabric-type surface, or any other impressions tending to form irregularities in the outer surface of the material utilized for cover 12.

Light reflectivity is frequently measured in terms of the so-called bi-directional reflectance distribution function (BRDF), which is defined as the ratio of the directional reflected radiance to the directional incident irradiance. Radiance is the radiant power flow per unit solid angle and unit area normal to the rays. Irradiance is the power flux density irradiating a surface per unit area of the surface. Devices for measuring BRDF are called gonioreflectometer, which usually include a light source and photometer. In the present invention, at light incidence angles of 10-90°, the bi-directional reflectance is preferably 0.50 or less, roughly comparable to the bi-directional reflectance of finished silk. By incorporating such reflectance into the surface of the material used for the cover 12, it will be appreciated that the cover 12 will not appear "shiny" or mirror-like in its presentation. By the same token, the actual surface of the material, as seen in microscopic cross-section, is preferably smooth and impervious to moisture, to facilitate cleaning.

What is desirable, therefore, is for the outer surface of the cover 12 to have a matte, as opposed to a gloss, finish.

Having thus described my invention, numerous modifications may be made thereto without departing from the essence of the invention, which I claim as follows:

1. A decorative cover for an object, said cover comprising:

flexible material generally conforming to the shape of said object, including a perimeter formed of said material and a top formed of said material and attached to said perimeter;

said flexible material having an outer surface;

an image applied to said outer surfaces of said top and said perimeter, said image comprising a color photograph of vegetation; and a weatherproof coating applied to said outer surface of said flexible material, wherein said weatherproof coating having a lower light reflectivity that has a bi-directional reflectance distribution function of less than 0.50.

2. The invention of claim 1, wherein said cover further comprises a plurality of attach points for securing said cover to said object, to a surface, or to both.

3. The invention of claim 1, wherein said coating further comprises a textured surface.

4. A decorative cover for an object, said cover comprising:

a top that is formed from a flexible material;

a perimeter that is formed from the flexible material, wherein the perimeter is attached to the top such that the perimeter surrounds the top and extends downward from the top, the perimeter having a bottom edge opposite the top that defines an open bottom, wherein the top and the perimeter are configured to generally conform to the shape of the object;

a first image applied to an outer surface of the top, the first image comprising a color photograph of a vegetative element taken from a top down perspective; and a second image applied to an outer surface of the perimeter, the second image comprising a color photograph of the vegetative element taken as a 360° view of the periphery of the vegetative element, wherein the first image and the second image, in combination, provide the appearance of the vegetative element to the top and the perimeter, in combination; and a coating applied to the top and the perimeter, wherein said coating is weatherproof and has a lower light reflectivity that has a bidirectional reflectance distribution function of less than 0.50.

5. The invention of claim 4, wherein:

said coating that is applied to the top and the perimeter, wherein the coating provides a textured surface to the top and the perimeter.

6. The invention of claim 4, wherein:

said coating that is applied to the top and the periphery, such that the top and the periphery more accurately emulate the appearance of the vegetative element.

7. The invention of claim 4, further comprising:

a plurality of eyelets that are disposed at spaced locations on the perimeter adjacent to the bottom edge thereof for securing the cover.

8. The invention of claim 4, wherein the flexible material is a synthetic fabric.

9. The invention of claim 4, wherein the flexible material is a plastic film.

10. A decorative cover for an object, said cover comprising:

a top that is formed from a flexible material;

a perimeter that is formed from the flexible material, wherein the perimeter is attached to the top such that the perimeter surrounds the top and extends downward from the top, the perimeter having a bottom edge opposite the top that defines an open bottom, wherein the top and the perimeter are configured to generally conform to the shape of the object;

a first image applied to an outer surface of the top, the first image comprising a first color photograph of a shrub or bush taken from a top down perspective; and a second image applied to an outer surface of the perimeter, the second image comprising a second color photograph of the periphery of the shrub or bush, wherein the first image and the second image, in combination, provide the appearance of the shrub or bush to the top and the perimeter, in combination; and a coating applied to the top and the perimeter, wherein said coating is weatherproof and has a lower light reflectivity that has a bidirectional reflectance distribution function of less than 0.50.

11. The decorative cover of claim 10, wherein the second color photograph is a 360° view photograph of the entire circumference of the shrub or bush.

12. The decorative cover of claim 10, wherein the first image and the second image, in combination, simulate the appearance of the shrub or bush.

13. The decorative cover of claim 10, wherein the first color photograph and the second color photograph are different photographs.

14. The decorative cover of claim 10, wherein the first image and the second image represent different visual perspectives.

15. The decorative cover of claim 10, wherein an overall image is defined by the first image and the second image in combination, and the overall image is discontinuous where the top meets the perimeter.

* * * * *